US011208825B2

(12) United States Patent
Schellhorn

(10) Patent No.: US 11,208,825 B2
(45) Date of Patent: Dec. 28, 2021

(54) EASY DUMP BUCKET WITH LATCHABLE DOOR

(71) Applicant: Travis Schellhorn, Independence, IA (US)

(72) Inventor: Travis Schellhorn, Independence, IA (US)

( * ) Notice: Subject to any disclaimer, the term of this patent is extended or adjusted under 35 U.S.C. 154(b) by 0 days.

(21) Appl. No.: 16/936,737

(22) Filed: Jul. 23, 2020

(65) Prior Publication Data

US 2021/0025189 A1 Jan. 28, 2021

Related U.S. Application Data

(60) Provisional application No. 62/877,466, filed on Jul. 23, 2019.

(51) Int. Cl.
*E04H 12/34* (2006.01)

(52) U.S. Cl.
CPC ..... *E04H 12/347* (2013.01)

(58) Field of Classification Search
CPC ..... E04H 12/347; B65F 1/125; B22D 41/06; B66B 17/26; B65D 90/58; B65D 90/587; B65D 90/626; E21B 27/02
See application file for complete search history.

(56) References Cited

U.S. PATENT DOCUMENTS 413,062 A * 10/1889 Howard ..... E21B 27/00 294/68.22
594,431 A * 11/1897 Riegel ..... F27D 3/10 414/199
737,449 A * 8/1903 McElhany ..... E21B 27/00 294/68.22
1,033,218 A * 7/1912 Twinberrow ..... B28C 5/0868 366/26
1,062,613 A * 5/1913 Smith ..... E21B 27/00 294/68.22
1,688,600 A * 10/1928 Slifer ..... B65D 90/587 193/21
1,923,678 A * 8/1933 Lowell ..... E04G 21/025 366/113
2,802,603 A * 8/1957 McCray ..... B65D 90/587 222/185.1
2,901,281 A * 8/1959 Martins ..... C11D 9/30 294/68.21
D251,916 S * 5/1979 Gendron ..... D23/202
(Continued)

*Primary Examiner* — Gregory W Adams

(74) *Attorney, Agent, or Firm* — Mark David Torche; Patwrite Law

(57) ABSTRACT

An easy dump bucket for installation of post has a bucket that is essentially tubular with a bottom portion and an opening towards a front bottom portion of the bucket. A pair of door tracks are vertically and parallelly located along the sides of the opening. A door is slidably disposed within the tracks and rests against the bottom portion when closed. The door slides upward to an open position by moving it up. A handle is connected to the door and interacts with a latch that keeps the door open. The bottom portion of the bucket is angled to gravitationally direct fill material towards the opening. A lifting arm is attached to a top portion of the bucket to allow the bucket to be lifted into place during use. A guide portion is disposed along the top portion of the bucket on the same side as the opening.

9 Claims, 11 Drawing Sheets

(56) References Cited

U.S. PATENT DOCUMENTS

| | | | | | |
|---|---|---|---|---|---|
| 4,423,831 | A * | 1/1984 | Sipley | B65D 90/623 | 222/181.3 |
| 5,281,067 | A * | 1/1994 | Ward | E04H 12/34 | 414/23 |
| 6,435,581 | B1 * | 8/2002 | House | E04G 21/025 | 294/68.1 |
| 6,860,700 | B2 * | 3/2005 | Powell | B65D 90/626 | 414/523 |
| 7,314,342 | B2 * | 1/2008 | Kerwin | E02F 3/96 | 222/410 |
| 9,102,460 | B2 * | 8/2015 | Pylinski | B28C 7/161 | |
| 2017/0217671 | A1 * | 8/2017 | Allegretti | B65D 90/14 | |

* cited by examiner

EASY DUMP BUCKET WITH LATCHABLE DOOR

CROSS REFERENCE TO RELATED APPLICATIONS

This application claims priority and herein incorporates by reference U.S. provisional patent application 62/877,466, filed Jul. 23, 2019.

BACKGROUND OF THE INVENTION

It is often necessary to sink construction posts, poles or other structural components in the ground. In many of these situations it is necessary to fill around the component with fill such as gravel. In these situations, the component such as a pole is placed in a prepared hole and then the gravel is poured around the pole filling the hole.

It is known to use many types of containers and equipment to transport and pour the fill around the pole; however because the pole is in the way, it is often difficult to pour the fill. There is a need for an easy and safe way to deliver fill to a prepared hole.

SUMMARY OF THE INVENTION

An easy dump bucket for installation of post has a bucket that is essentially tubular with a bottom portion and an opening towards a front bottom portion of the bucket. A pair of door tracks are vertically and parallelly located along the sides of the opening. A door is slidably disposed within the tracks and rests against the bottom portion when closed. The door slides upward to an open position by moving it up. A handle is connected to the door and interacts with a latch that keeps the door open. The bottom portion of the bucket is angled to gravitationally direct fill material towards the opening. A lifting arm is attached to a top portion of the bucket to allow the bucket to be lifted into place during use. A guide portion is disposed along the top portion of the bucket on the same side as the opening.

Other features and advantages of the instant invention will become apparent from the following description of the invention which refers to the accompanying drawings.

DETAILED DESCRIPTION OF THE INVENTION

Figure 1:
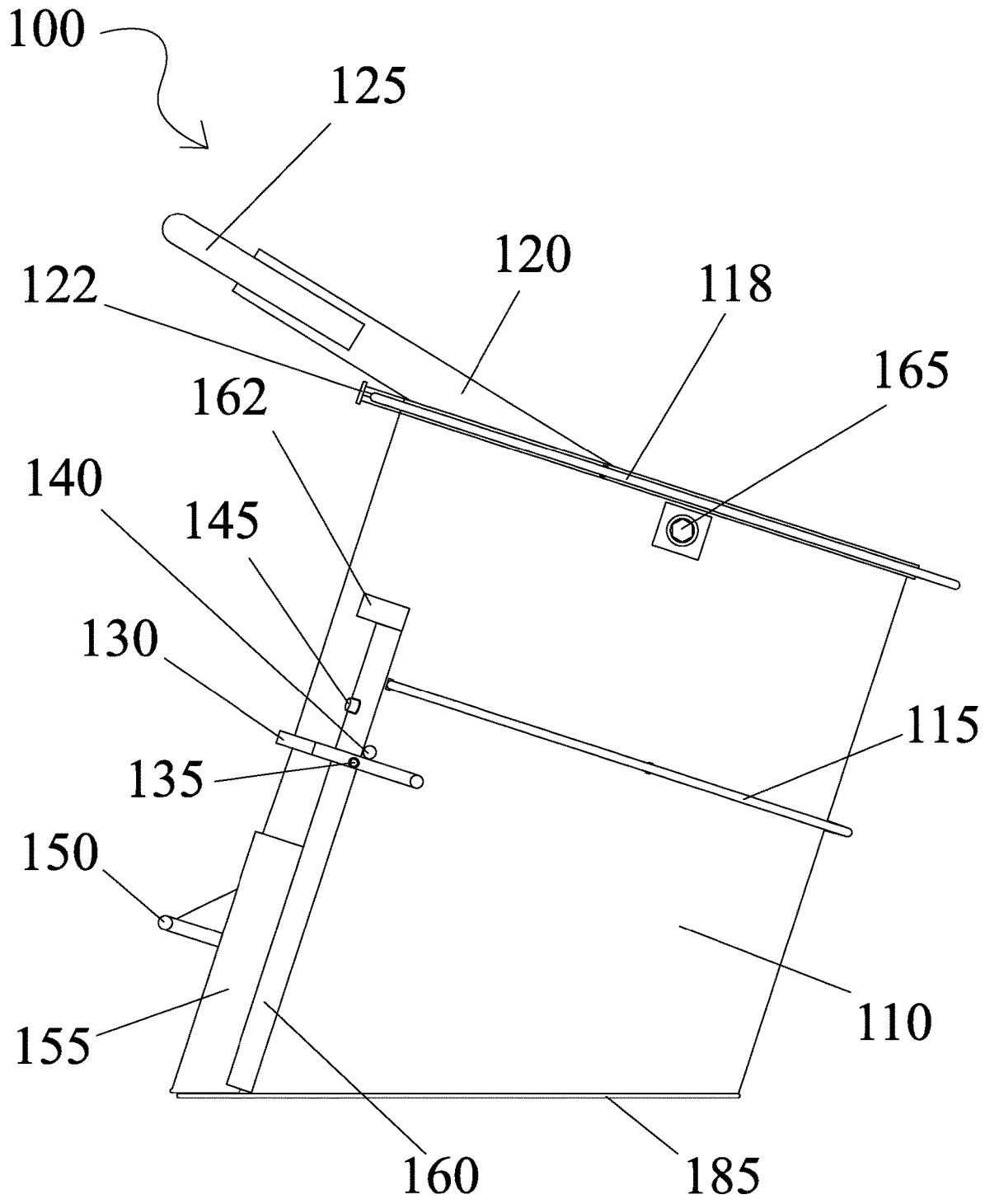
FIG. 1 is a side view of an easy dump bucket according to an embodiment of the invention.
Figure 2:
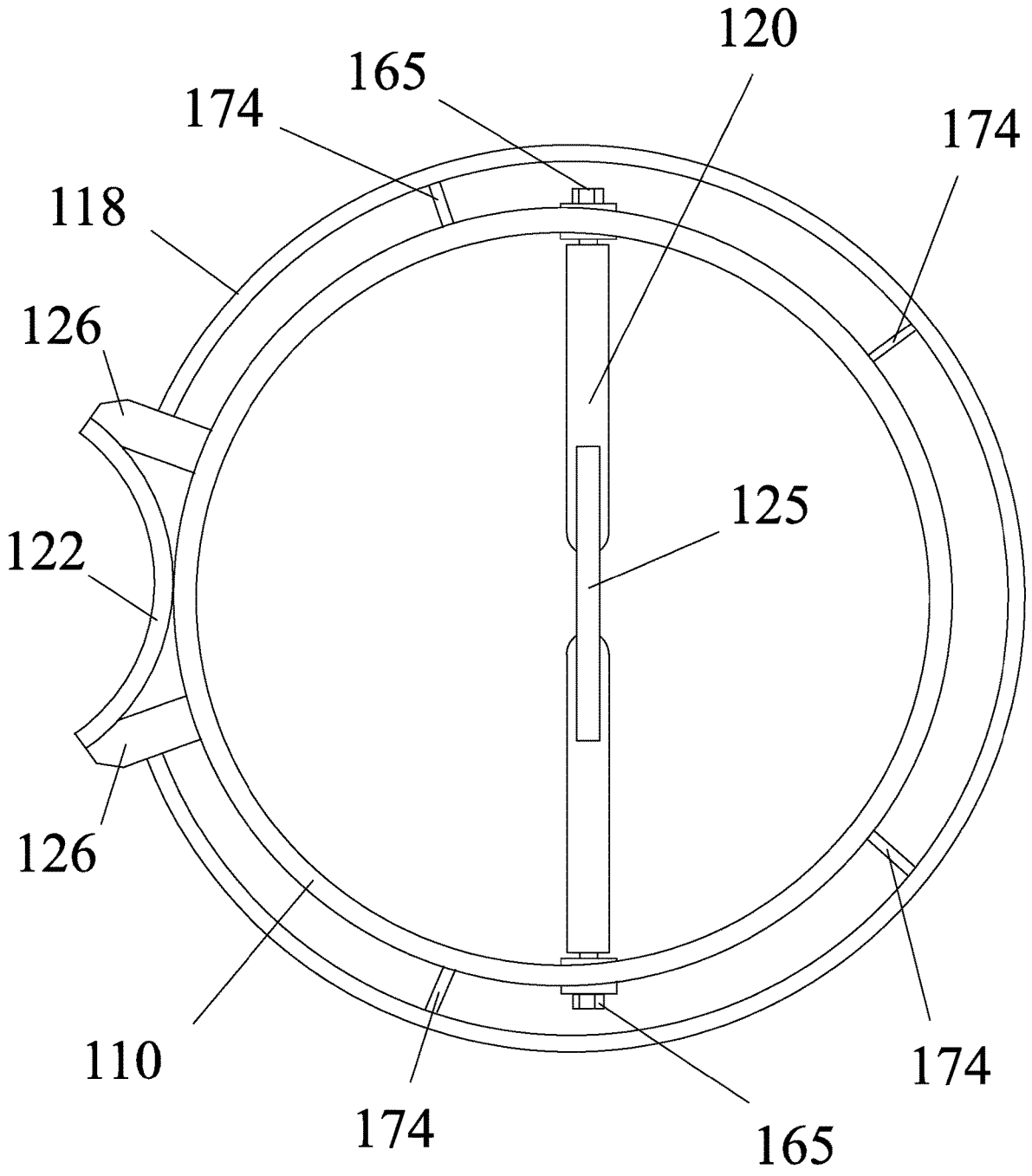
FIG. 2 is a top view of the easy dump bucket shown in FIG. 1.
Figure 3:
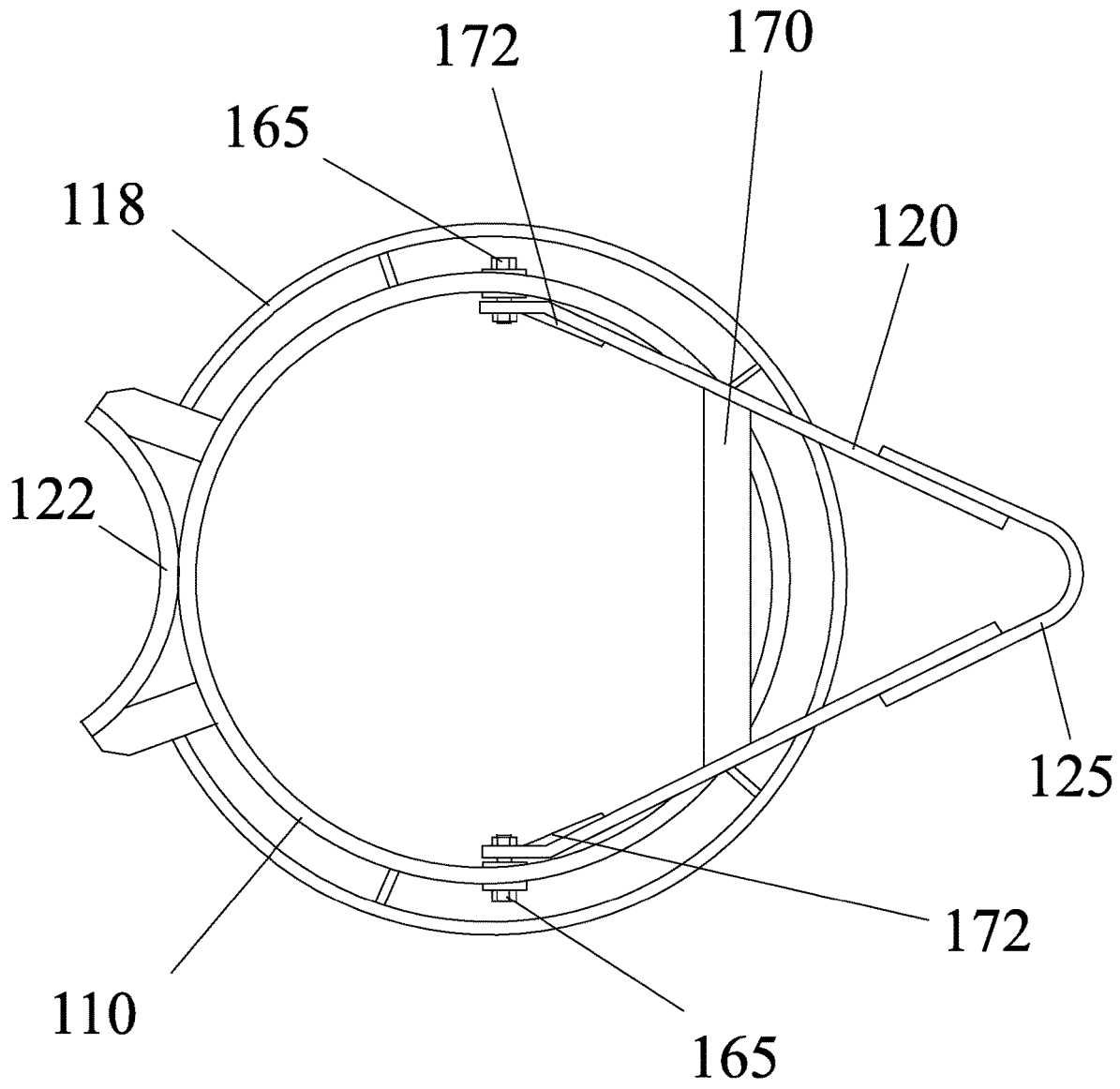
FIG. 3 is a top view of the easy dump bucket shown in FIG. 1 with lifting arm hinged down.
Figure 4:
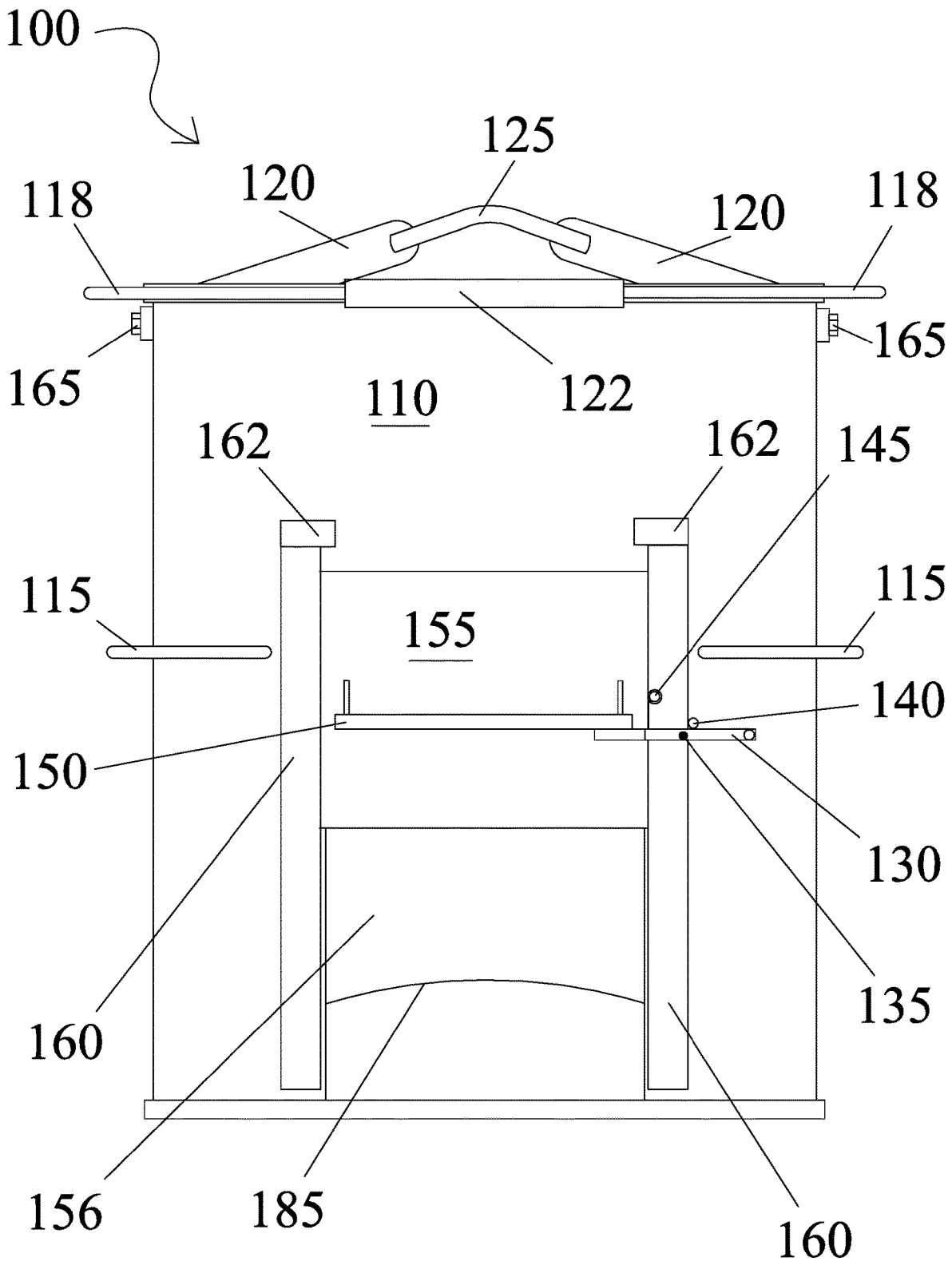
FIG. 4 is a front view of the easy dump bucket shown in FIG. 1 with a right-handed latch.
Figure 5:
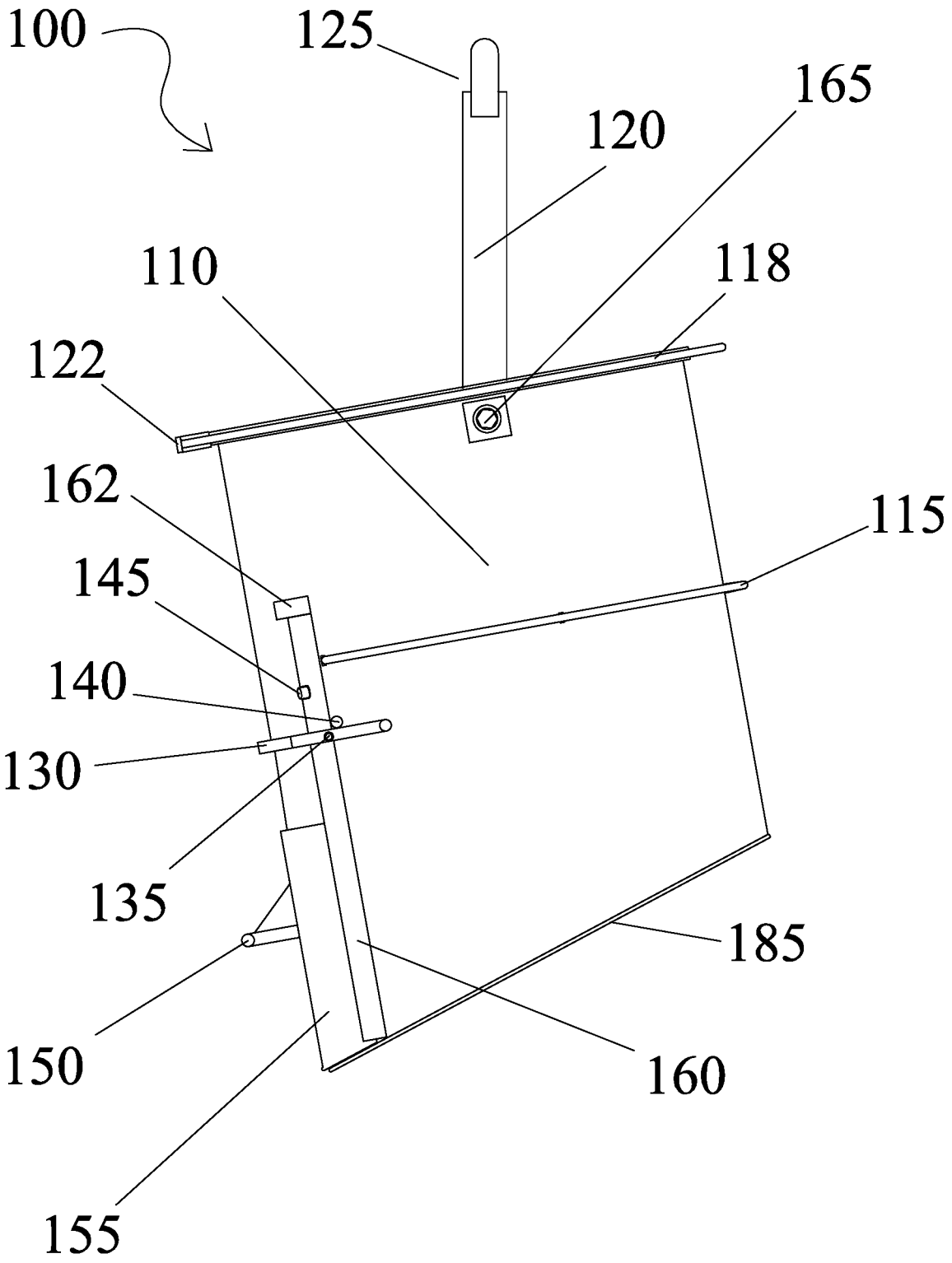
FIG. 5 is a side view of the easy dump bucket shown in FIG. 1 in a suspended configuration.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to FIGS. 1-6, an easy dump bucket 100 is shown having a bucket 110 with a control rail 115 and a guide rail 118 which allow an operator to move and position easy dump bucket 100 during use. Guide rail 118 is attached to bucket 110 by guide rail supports 174 A lifting arm 120 is rotably connected to bucket 110 with a lifting arm bolt 165 located on each side of bucket 110. Lifting arm 120 may be located off-center to aid in control when emptying bucket 110. A lifting hook 125 is attached to lifting arm 120 to facilitate connecting easy dump bucket 100 to a lifting hook 175. Lifting hook 175 is removably connected to a chain 190 which is supported by a machine (not shown) such as a backhoe or crane. Lifting hook 175 may also be attached to a cable or other suitable connecting material as is known in the art. Of course other attachment means may be used such as, but not limited to, rivets, hinge pins, etc. as long as lifting arm 120 is able to rotate to a stable position during use (see for example FIG. 5.) Lifting arm 120 is shown having a stiffener 170 to provide additional stability along with a pair of stiffeners 172 to reinforce lifting arm 120.

A door 155 moveable slides within two door tracks 160 welded to bucket 110. A door 155 has a handle 150 used to open and close door 155. A door latch 130 is provided to hold door 155 in an open position. Door latch 130 rotatably moves around a door latch pivot 135 and is restrained from rotating counterclockwise by a door latch limit 140 when handle 150 is resting against door latch 130. In use, door latch 130 is rotated clockwise until handle 150 clears door latch 130 while being limited from rotating further by a door latch limit 145. Once handle 150 moves to an open position, door latch 130 rotates counterclockwise and keeps handle 150 from closing. To close door 150, door 150 is moved upward; door latch 130 is rotated out of the way and door 155 is lowered to a closed position. Of course other door opening and closing means may be used as long as an opening in bucket 110 is controllable such as, but not limited to, hinges, panels or other suitable doors.

To prevent door 155 from sliding up and out of door tracks 160, door stops 162 are used to limit the travel. Bucket 110 has an angled bottom 185 that helps empty contents when in use. To restrain door 155 from falling down and out of door tracks 160, door 155 rests against a portion of angled bottom 185. The angle of bottom 185 is selected to work reasonably well regardless of the kind of material contained within bucket 110 when filled. Alternatively, the angle may be selected to match the kind of materials to be used such as gravel, sand or other fill material. Since bottom 185 is welded, if an angle specific bucket is desired, it is offered as a preselected configuration during manufacture. A guide portion 122 is disposed along a top portion of bucket 110. A pair of guide portion supports 126 are provided to secure guide portion 122 to bucket 110. The selected angle can be anywhere from a few degrees to 45 degrees. The inside of bucket 110 could be coated with a coating to in emptying fill 180.

Figure 6:
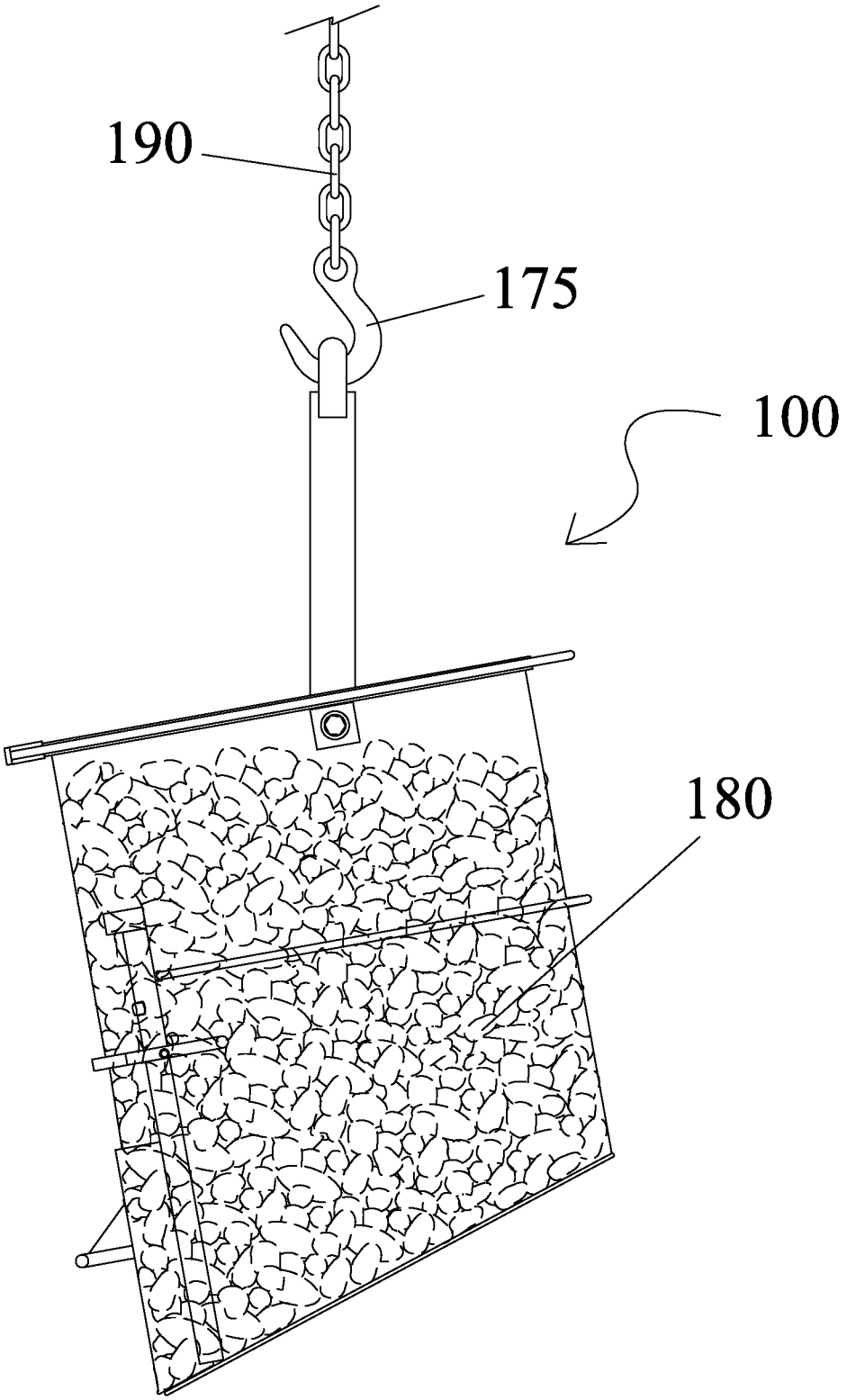
FIG. 6 is a transparent view of the easy dump bucket shown in FIG. 4.
Figure 7:
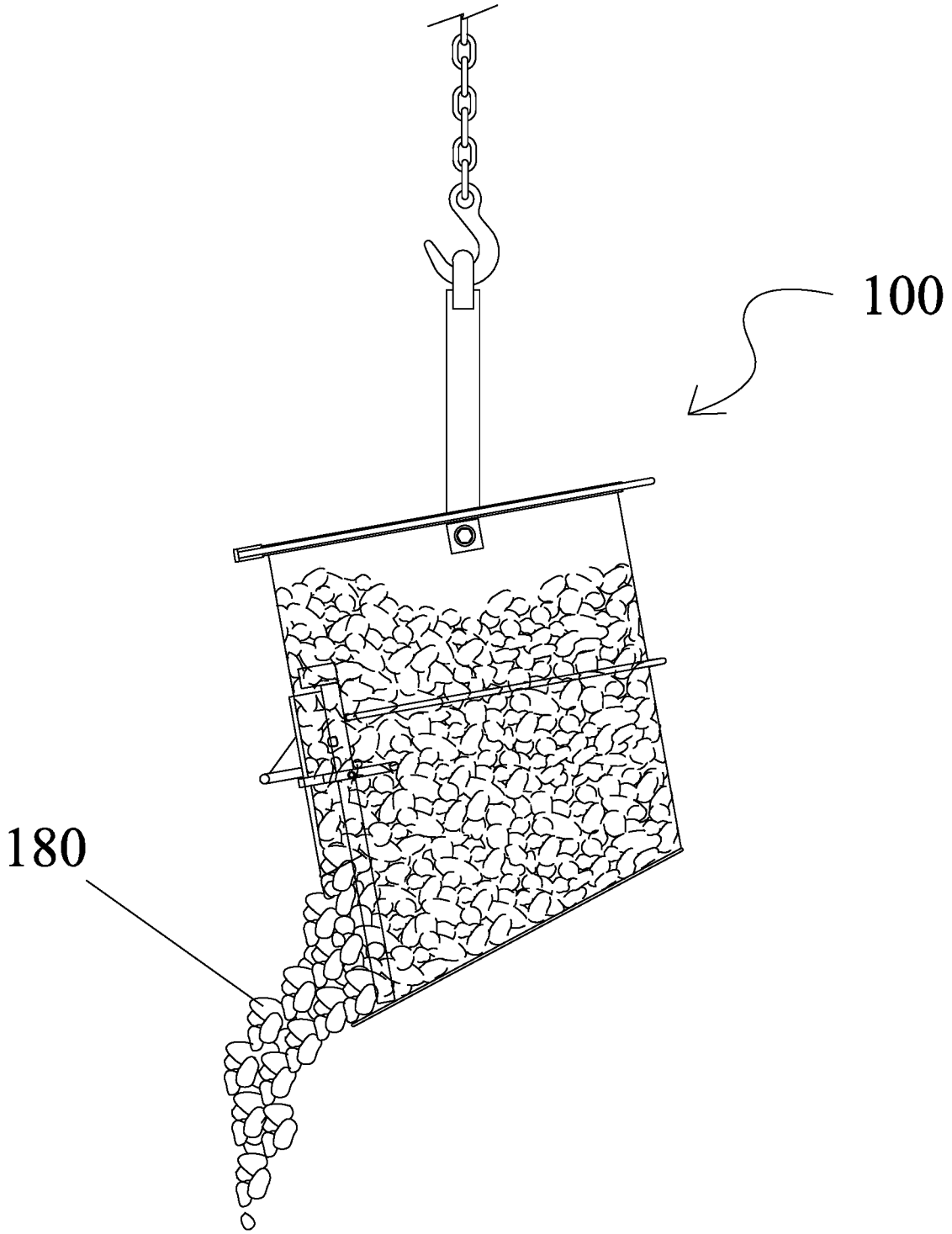
FIG. 7 is a transparent view of the easy dump bucket shown in FIG. 5 being emptied.
Figure 8:
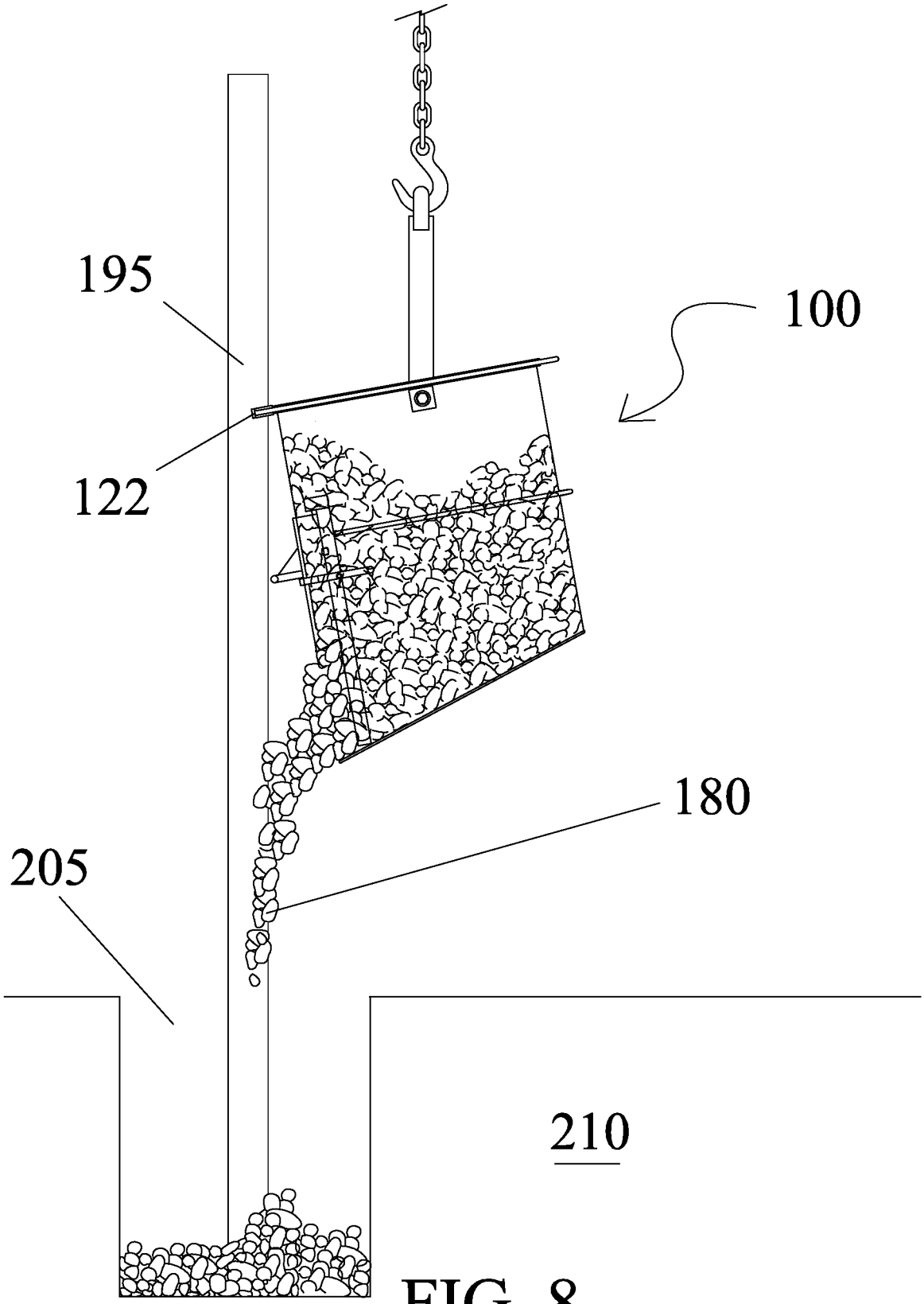
FIG. 8 is a transparent view of the easy dump bucket shown in FIG. 7 in a typical post and hole filling operation.

Now referring to FIGS. 6-8, easy dump bucket 100 is shown suspended and holding fill 180. In use, a hole 205 is prepared in the earth 210 and a utility pole 195 is placed for installation. Easy dump bucket 100 is placed against utility pole 195 by alignment with guide portion 122 and door 155 is moved to an open position allowing fill 180 to fall into hole 205 and the user can direct fill 180 around utility pole 195 using control rail 115 and guide rail 118. Of course other uses are possible, such as but not limited to, fence posts, sports equipment, or merely filling holes with fill and should be considered to fall within the disclosure herein.

Figure 9:
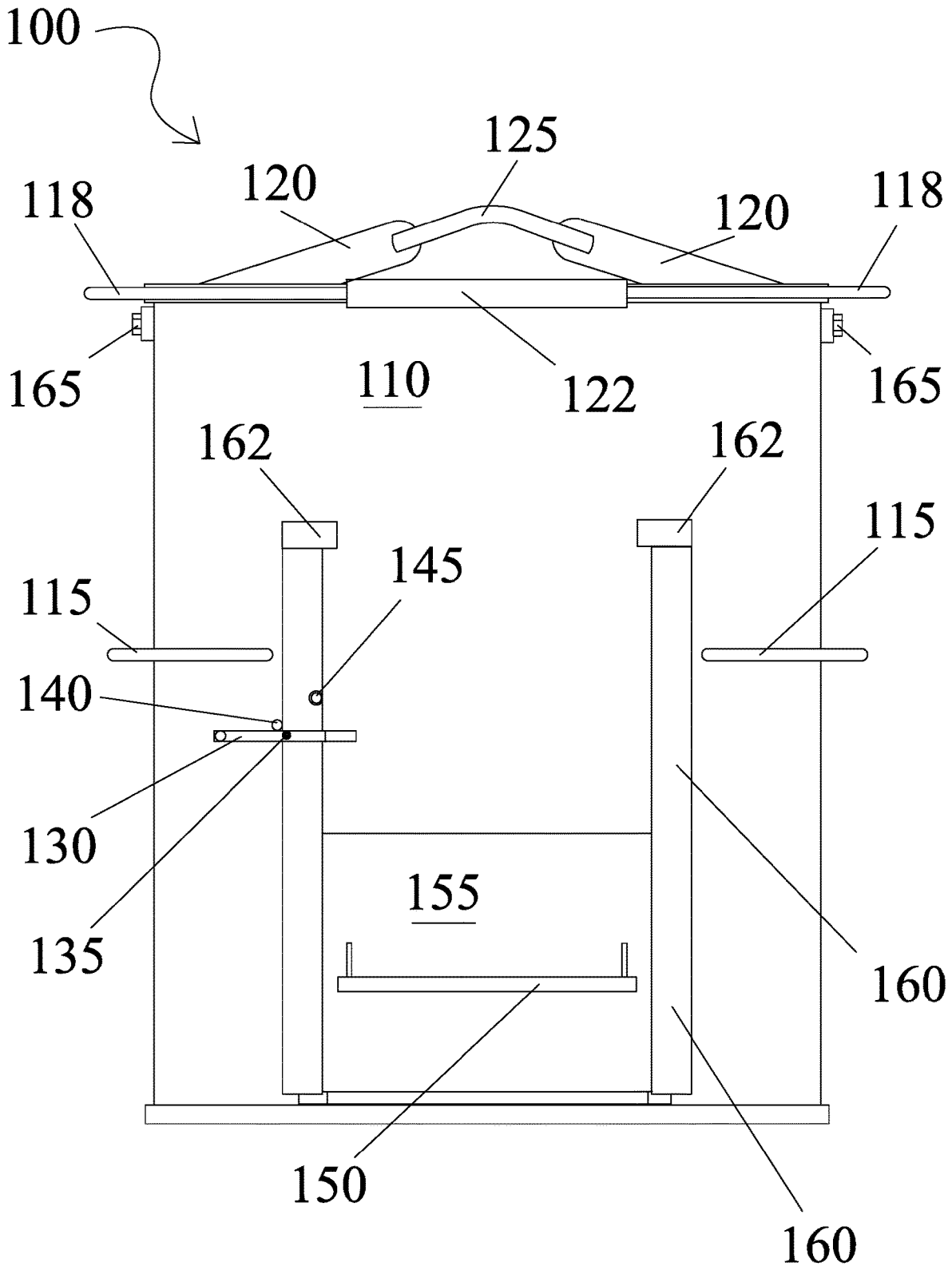
FIG. 9 is a front view of the easy dump bucket shown in FIG. 1 with a left-handed latch.
Figure 10:
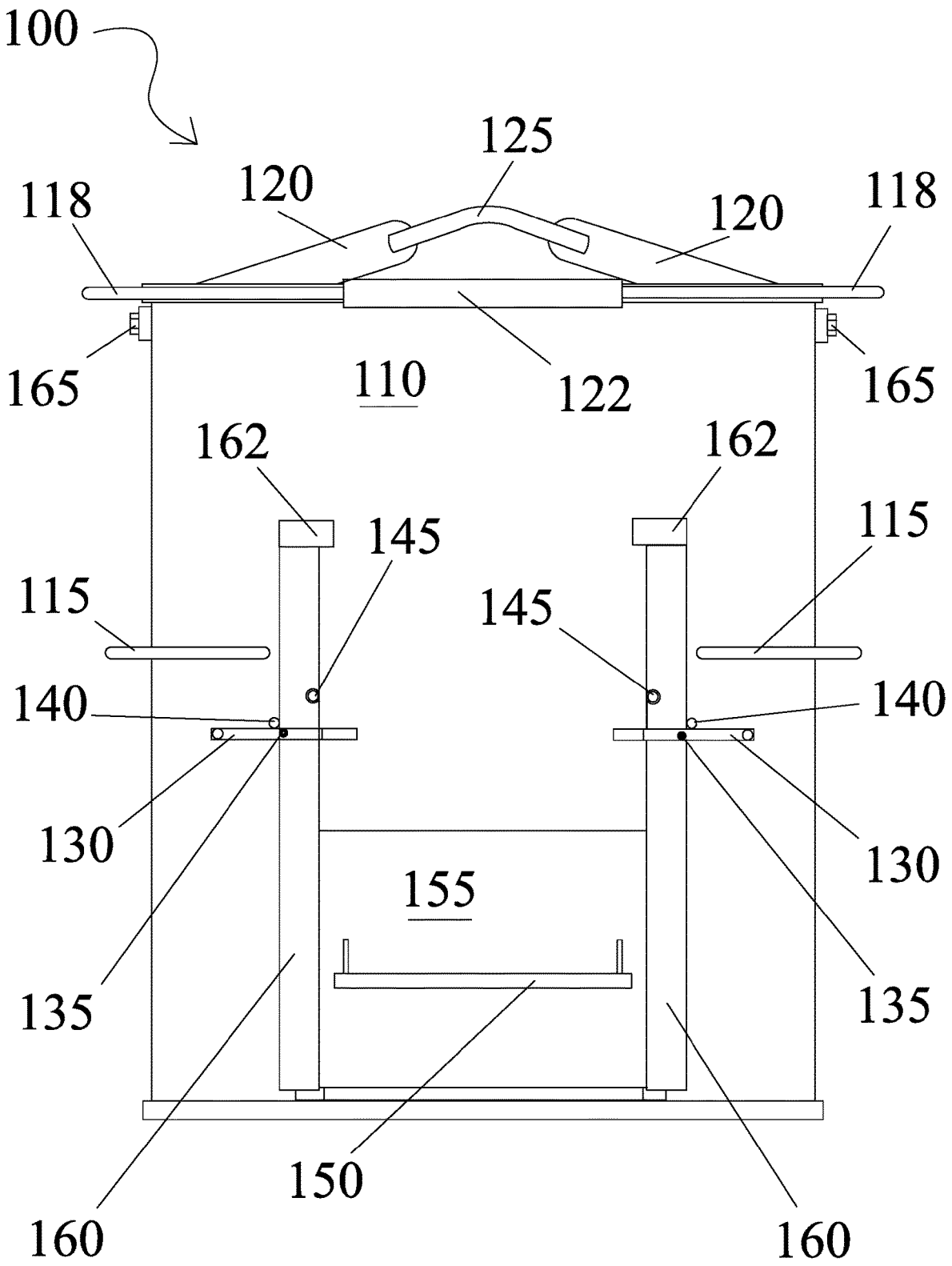
FIG. 10 is a front view of the easy dump bucket with both left and right handed latches.

Referring now to FIG. 9, easy dump bucket is shown have a left handed door latch 130 to be used in conditions where it is advantageous to allow the user to operate the door from the opposite side to easy dump bucket 100 shown in FIGS. 1-5. FIG. 10 shows easy dump bucket 100 with door latches 130 on both sides to further allow a user more flexibility in use. Easy dump bucket is made of steel with bottom 185 being welded along with control rail 115 and guide rail 118 being welded as well. Of course easy dump bucket 100 may be made of other materials, such as, but not limited to, plastic, composites, etc. depending on the use as long as the material chosen in sufficiently strong to hold the desired fill material. Also, all attachments such as guide rail, control rail, door track, etc. may be bolted or otherwise attached as long as they are secured to bucket 110.

Figure 11:
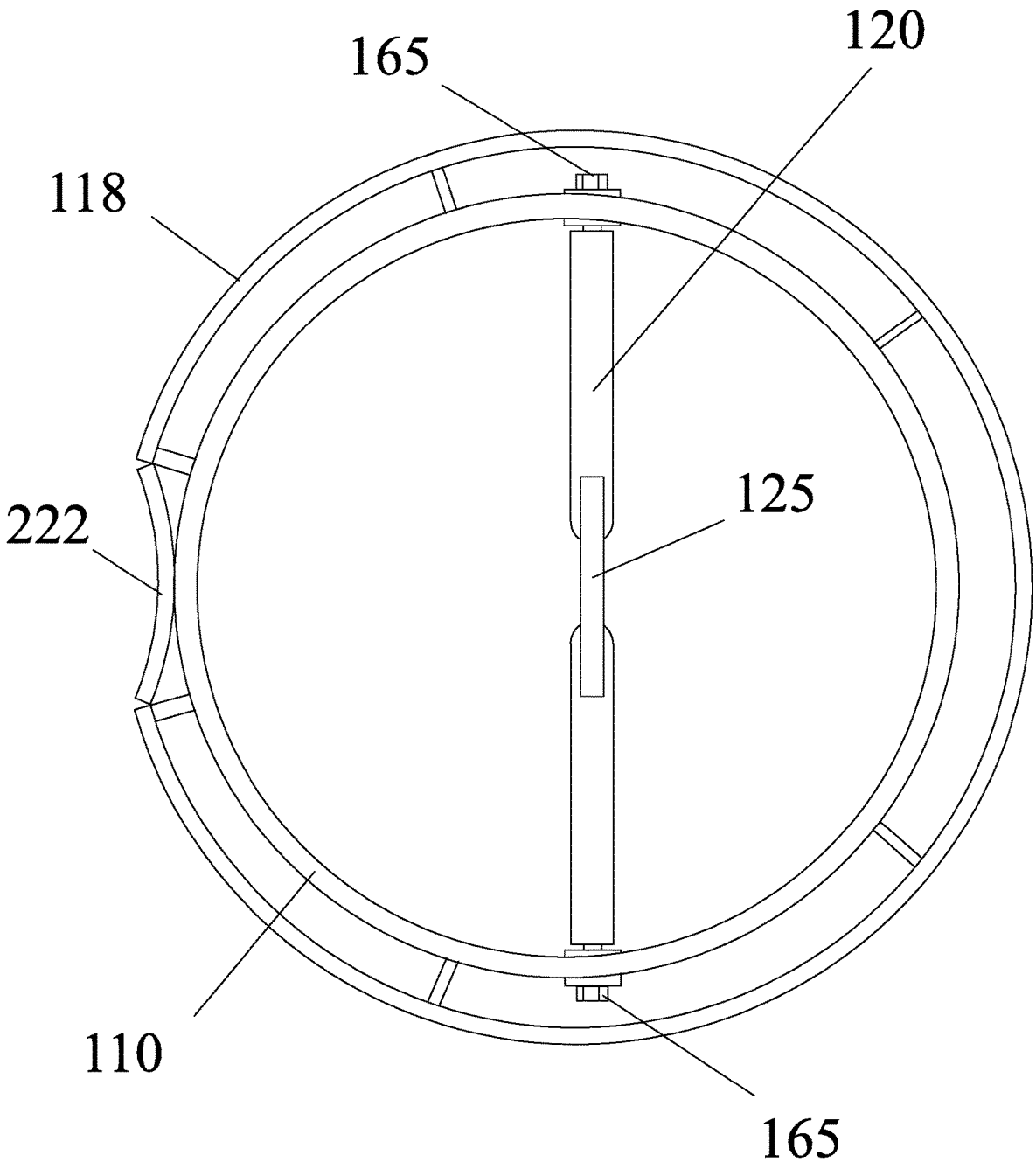
FIG. 11 is a top view of an easy dump bucket with an alternative guide portion geometry.

Referring now to FIG. 11, bucket 110 is shown having a different geometry for a guide portion 222 that may be used depending on the application. Other geometries may be used to match particular poles being installed such as a triangular or rectangular guide portion (not shown) to work with square posts, etc.

Although the instant invention has been described in relation to particular embodiments thereof, many other variations and modifications and other uses will become apparent to those skilled in the art.

What is claimed is:

1. An easy dump bucket comprising a bucket;

said bucket being essentially tubular with a bottom portion;

said bucket having an opening along a forward bottom portion of said bucket;

a pair of door tracks vertically and parallelly disposed along the sides of said opening;

a door slidable disposed within said door tracks;

said door adapted to rest against said bottom portion when in a closed position;

said bottom portion having an angle selected to gravitationally direct a fill material loaded into said bucket towards said opening;

a guide portion disposed along a top portion of said bucket and disposed on a same side as said door;

a lifting arm hingedly attached to a top portion of said bucket wherein said lifting arm is adapted for attachment to a lifting device;

said guide portion adapted to fit against a post wherein said post is disposed within a prepared hole;

a door handle attached to said door whereby said door is slidably moved from said closed position to an open position; and a door latch rotably attached to one of said pair of door tracks whereby said door is selectively held in said open position when said door latch is engaged.

2. The easy dump bucket according to claim 1 further comprising a guide rail circumferentially disposed along said top portion of said bucket.

3. The easy dump bucket according to claim 2 further comprising a control rail circumferentially disposed on said bucket and below said guide rail.

4. The easy dump bucket according to claim 1 wherein said door latch is located on a left side of said door.

5. The easy dump bucket according to claim 1 wherein said door latch is located on a right side of said door.

6. The easy dump bucket according to claim 1 further comprising a second door latch rotably attached to an opposite door track whereby said door is selectively held in said open position from either side of said pair of door tracks.

7. The easy dump bucket according to claim 1 further comprising a door latch limit along a top portion of at least one of said pair of door tracks wherein said door is limited from sliding out of said pair of door tracks.

8. The easy dump bucket according to claim 1 wherein said lifting arm is disposed at a selected location that is offset from a center of gravity location whereby said bucket is more easily operated when loaded.

9. The easy dump bucket according to claim 1 wherein said angle is selected to match a particular fill material.

* * * * *